US007621157B2

(12) United States Patent
Marioni

(10) Patent No.: US 7,621,157 B2
(45) Date of Patent: Nov. 24, 2009

(54) WASHING-MACHINE AND SIMILAR HOUSEHOLD APPLIANCES WITH ROTARY DRUM

(75) Inventor: Elio Marioni, Dueville (IT)

(73) Assignee: Askoll Holding S.r.l. (IT)

( * ) Notice: Subject to any disclaimer, the term of this patent is extended or adjusted under 35 U.S.C. 154(b) by 423 days.

(21) Appl. No.: 11/278,240

(22) Filed: Mar. 31, 2006

(65) Prior Publication Data

US 2006/0218974 A1 Oct. 5, 2006

(30) Foreign Application Priority Data

Apr. 1, 2005 (EP) ..... 05425192

(51) Int. Cl.
*D06F 37/30* (2006.01)

(52) U.S. Cl. ..... 68/131; 68/133

(58) Field of Classification Search ..... 68/131, 68/133

See application file for complete search history.

(56) References Cited

U.S. PATENT DOCUMENTS

| | | | | |
|---|---|---|---|---|
| 2,354,208 | A * | 7/1944 | Haberstump | 68/61 |
| 2,609,253 | A * | 9/1952 | Brown | 384/204 |
| 3,066,886 | A * | 12/1962 | Beaver et al. | 242/130.4 |
| 3,548,615 | A * | 12/1970 | Ohnishi et al. | 68/23.1 |
| 4,372,718 | A * | 2/1983 | Zaydel | 411/105 |
| 4,623,810 | A * | 11/1986 | Smith | 310/90 |
| 5,020,767 | A * | 6/1991 | Ueda et al. | 248/638 |
| 5,494,356 | A * | 2/1996 | Strobl | 384/204 |
| 5,775,138 | A * | 7/1998 | Durazzani et al. | 68/140 |
| 6,700,255 | B1 * | 3/2004 | Stenta | 310/90 |
| 6,760,231 | B2 * | 7/2004 | Hung et al. | 361/758 |
| 7,005,769 | B1 * | 2/2006 | Fisher et al. | 310/90 |

FOREIGN PATENT DOCUMENTS

| | | | |
|---|---|---|---|
| DE | 36 01 171 | * | 8/1986 |
| EP | 1 424 427 | A | 6/2004 |
| ES | 2162530 | * | 12/2001 |
| FR | 2 691 593 | A | 11/1993 |
| FR | 2 742 843 | A | 6/1997 |
| GB | 1 318 779 | A | 5/1973 |
| GB | 2 086 946 | * | 5/1982 |
| JP | 63-154424 | * | 6/1988 |
| JP | 11-265947 | * | 9/1989 |
| JP | 2002-122117 | * | 4/2002 |
| KR | 2003034623 | * | 5/2003 |

OTHER PUBLICATIONS

European Patent Office 0 152 745, Aug. 1985.*
European Patent Office 0 214 510, Mar. 1987.*
European Patent Office 1 029 963, Aug. 2000.*

* cited by examiner

*Primary Examiner*—Frankie L Stinson
(74) *Attorney, Agent, or Firm*—Akerman Senterfitt

(57) ABSTRACT

A washing machine, with an unusually easy assembly, having an electric motor with a central axis and a washing tank having a fixing bracket, to fix the electric motor to the tank. The fixing bracket includes a first arm and a second arm. The machine has structure associated with at least one of the first and second arms to lock the central axis of the motor. The insertion of the central axis in the arm and the locking thereof are shown in different embodiments.

11 Claims, 6 Drawing Sheets

14¶

WASHING-MACHINE AND SIMILAR HOUSEHOLD APPLIANCES WITH ROTARY DRUM

FIELD OF THE INVENTION

The present invention relates, in its more general aspect, to a washing machine and similar rotary drum household appliances.

In particular, but not limitatively, this invention relates to a machine as above comprising a central-axis electric motor and a washing tank.

BACKGROUND OF THE INVENTION

As it is known, the washing machine rotary drum is rotation-actuated by a central-axis electric motor, connected, by means of a driving belt, to a pulley being integral with the rotary drum.

The electric motor is fixed on the washing tank by means of a fixing bracket welded to the tank itself. In particular the fixing bracket is screwed, welded or otherwise locked to the washing tank surface.

In order to allow the electric motor to be fixed to the fixing bracket, the motor must be assembled on a motor bearing. The fixing occurs by screwing the motor bearing onto the fixing bracket in several points.

This working mode involves a certain assembly difficulty due, first of all, to the motor bearing assembly to the electric motor itself. Moreover the motor bearing must be precisely positioned in correspondence with the screwing points to the fixing bracket for the subsequent screwing.

A further drawback is caused by the high vibration due to the rotary drum rotary motion which can jeopardize the fixing in one or more fixing points and lead to noise problems during the washing machine working.

The technical problem underlying the present invention is thus to simplify the washing machine assembly allowing the electric motor to be rapidly and securely fixed, overcoming the limits and/or drawbacks still limiting the washing machines realised according to the prior art.

SUMMARY OF THE INVENTION

The solution provided by the present invention is to design a washing tank comprising a fixing bracket to engage and rapidly lock the electric motor, favouring the rapid positioning thereof and a balanced and secure locking to the washing tank.

This technical problem is solved according to the present invention by a washing machine, of the type comprising an electric motor 4 with central axis 10 and a washing tank 1 characterised in that it comprises a fixing bracket 3 to fix the electric motor 4 to the tank 1 comprising an arm 5, a second arm 7 and means associated to at least one of said first or second arm to lock the central axis 10 of the electric motor 4.

Further features and advantages of the washing tank and of the assembly method according to the invention will be apparent from the following description of an embodiment thereof with reference to the attached drawings given by way of non-limiting example.

DETAILED DESCRIPTION OF THE INVENTION

Figure 1:
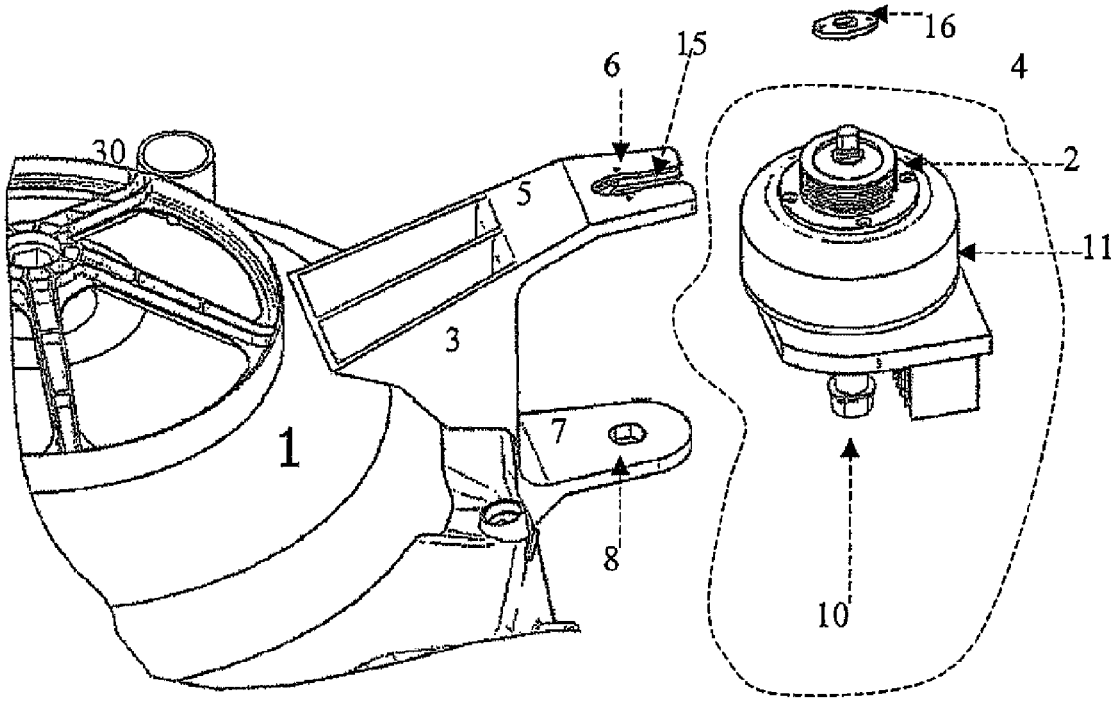
FIG. 1 schematically shows the washing tank of a washing machine comprising a fixing bracket and a central-axis electric motor according to the present invention.
Figure 2A:
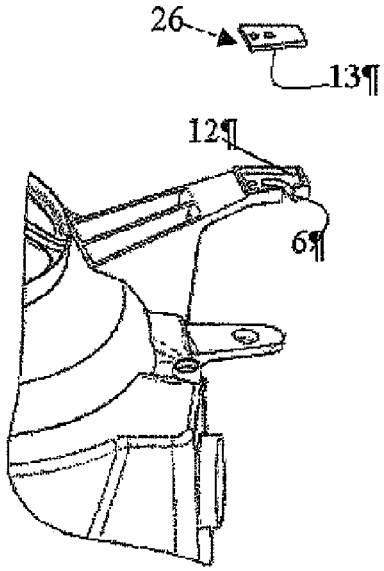
FIGS. 2*a*, 2*b*, 2*c*, 2*d* schematically show the washing tank close to the fixing bracket and a coupling plate; an electric motor; the electric motor in engagement with the fixing bracket; the electric motor definitively fixed to the fixing bracket respectively.
Figure 2B:
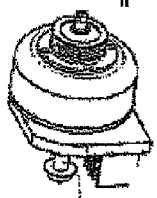
Figure 2C:
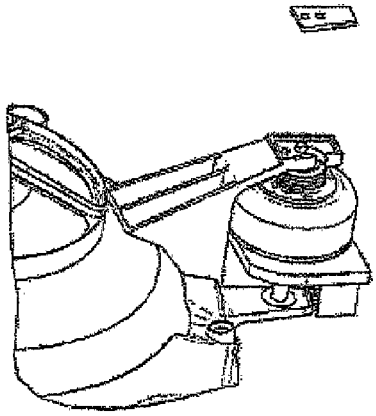
Figure 2D:
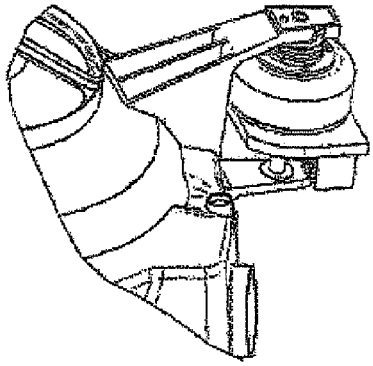
Figure 3A:
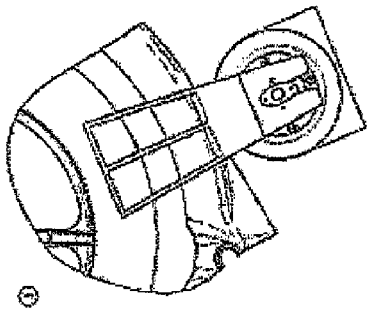
FIGS. 3*a*, 3*b*, 3*c*, 3*d*, 3*e* schematically show a motor and the washing tank close to the fixing bracket, associated to an insertion and side-clamping plate respectively according to: a top view wherein the insertion and clamping plate is not clamped; a top view with the insertion and clamping plate being clamped; a perspective view with the insertion and clamping plate not being inserted; a top sectional view with the insertion and clamping plate being clamped; an exploded perspective view.
Figure 3B:
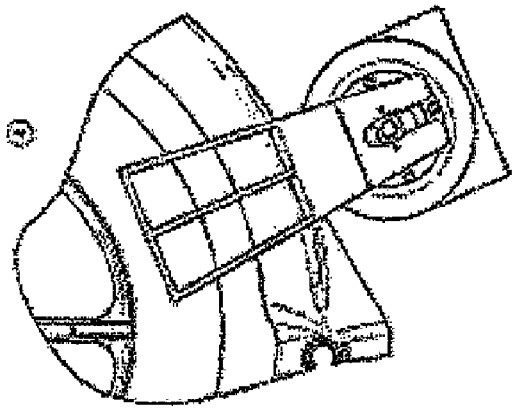
Figure 3C:
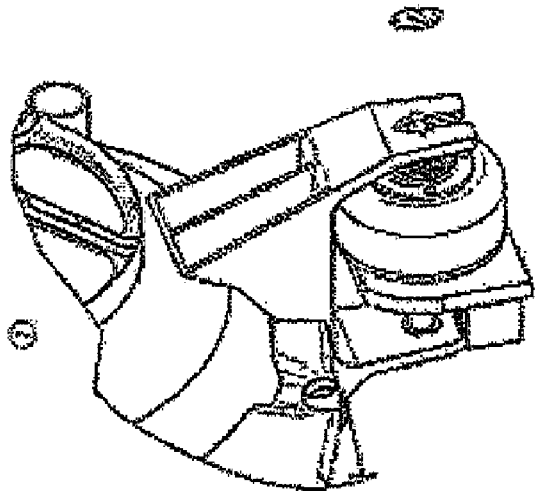
Figure 3D:
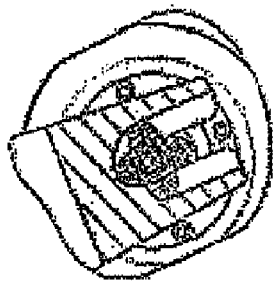
Figure 3E:
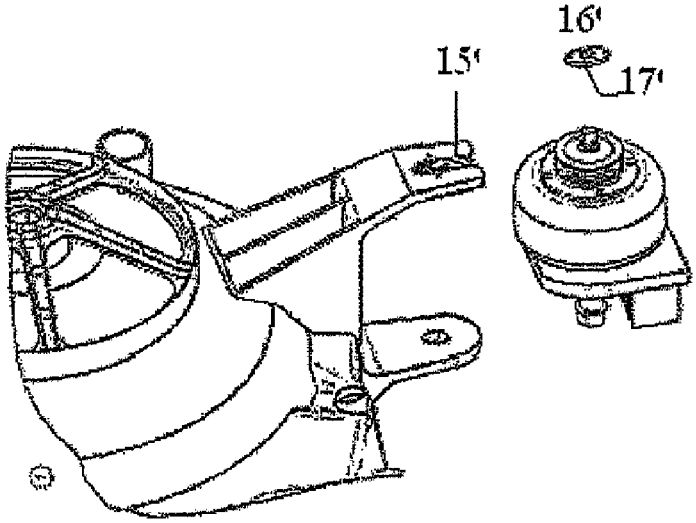

With reference to FIG. 1, the washing tank of a washing machine as previously indicated is schematically shown and indicated with 1. FIG. 1 shows a detail of the washing machine, concerning the back part, with respect to the laundry insertion door of the washing tank 1.

In particular the driving pulley 30 of the rotary motion transmitted from the electric motor 4 to the rotary drum can be noted on the back part of the washing tank 1. This rotary drum, not shown in this figure, lies inside the washing tank 1. The washing tank 1 has a projecting part, hereafter indicated as fixing bracket 3, comprising a first and a second arm to fix the electric motor 4 to the washing tank 1.

Advantageously, according to the present invention, the fixing bracket 3 to fix the electric motor 4 to the washing tank 1 comprises a first arm 5 and means associated to said first arm 5 to lock the central axis 10 to the first arm 5.

A second arm is also provided in the bracket 3 which is substantially "C"-shaped like a globe support.

The means associated to the first arm 5 comprise an assisted-insertion slot 6 made at the end of said first arm 5.

The first arm 5 comprises a groove 12 obtained on the surface thereof and a coupling plate 26 with the groove 12, having a through hole 13 with the same shape as the upper end of the central axis 10.

Said means also comprise a longitudinal slot 15 being parallel to the surface of the first arm 5 made in correspondence with the assisted-insertion slot 6 and an insertion and clamping plate 16, sideways inserted through the central axis 10 at the end of the assisted-insertion slot 6 and clamped in the longitudinal insertion slot 15.

An insertion and clamping plate 18 directly assembled on said central axis 10 can be inserted through the longitudinal slot 15 jointly with the central axis 10 and clamped in the longitudinal insertion slot itself.

Said longitudinal slot 15, in correspondence with the end part of the assisted-insertion slot 6 is such as to ensure a secure clamping motion of said insertion and clamping plate 16.

A second arm 7, whose end has an engaging through hole 8, is used to fix the electric motor to the washing machine tank.

An engaging through hole 8 obtained in the second arm 7 and the lower end of the central axis 10, engaging in the engaging through hole 8, have a conjugate shape and such as to prevent the rotary motion.

Further locking means comprise a joint insertion channel 19 made at the end of said arm 5 and a joint plate 20 with the joint insertion channel 19, having a non-through hole 21 with the same shape as the upper end of the central axis 10.

One or more bushes 22, welded to the washing tank 1, and a bush screwing bearing 23, fitted onto the central axis 10, are used like fixing means in a further alternative embodiment of the invention.

FIG. 1 schematically shows the detail of the washing tank corresponding to the fixing bracket indicated with 3, in an embodiment according to the present invention. The fixing bracket 3, in this example given by way of non limiting example, comprises a first arm 5 and a second arm 7. This first arm 5 has, at the end thereof, an assisted-insertion slot 6 with such a thickness as to favour the insertion of the central axis 10 of the electric motor 4.

FIG. 1 also shows an inner-stator electric motor, constrained to a central axis 10. Outside the inner stator 2, an outer rotor, indicated with 11, is free to rotate around the inner stator 2. Also this example of inner-stator and outer-rotor electric motor is given by way of non limiting example with respect to other kinds of electric motors.

The assisted-insertion slot 6, with an overall thickness corresponding to the diameter of the central axis 10, has a thickening in the end part of the assisted-insertion slot 6.

The second arm 7 of the fixing bracket 3 has instead a through hole with a conjugate shape with respect to the lower part of the central axis 10. The figure also shows an insertion and clamping plate 16 comprising a hole with a conjugate shape with respect to the upper part of the central axis 10.

A longitudinal slot 15 is made in correspondence with the assisted-insertion slot 6.

Advantageously, according to the present invention, the assembly of the electric motor 4 to the washing tank 1 occurs by means of the fast engagement of the lower part of the central axis 10 in the through hole 8 of the second arm 7 and the sideways assisted insertion of the axis 10 itself in the assisted-insertion slot 6.

The insertion being performed, the fixing of the central axis 10 to the arm 5 of the fixing bracket 3 occurs by inserting the insertion and clamping plate 16 through the central axis 10 and by clamping it through a semicircular motion, inside the longitudinal slot 15.

Different alternative embodiments of the present invention allow the electric motor 4 to be locked. In an embodiment being different from the above-described one and schematically shown in FIG. 2, the fixing of the central axis 10 to the first arm 5 occurs by means of a coupling plate 26, fitted through the central axis 10 in the groove 12 and hinged thereto.

Figure 4A:
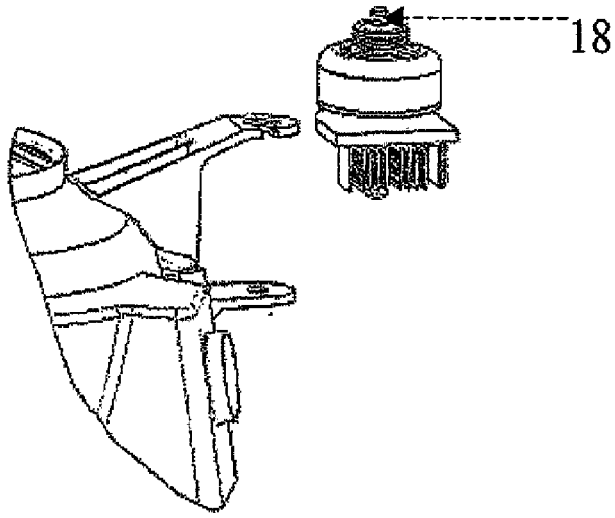
FIGS. 4*a*, 4*b*, schematically show an electric motor and the washing tank close to the fixing bracket, associated with an insertion and clamping plate incorporated onto the central axis. The figures relate to a perspective view being respectively exploded and assembled.
Figure 4B:
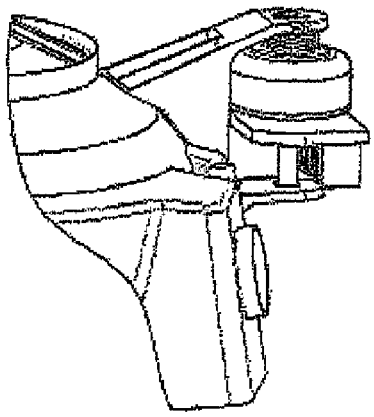
Figure 5A:
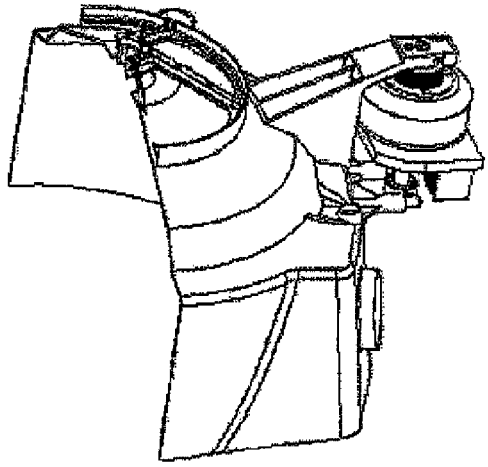
FIGS. 5*a*, 5*b*, 5*c* and 5*d* schematically show an electric motor and the washing tank close to the fixing bracket, associated with a coupling plate and with a screwing bush. The figures are respectively assembled, exploded, with a detail of the screwing bush and exploded, from different angles.
Figure 5B:
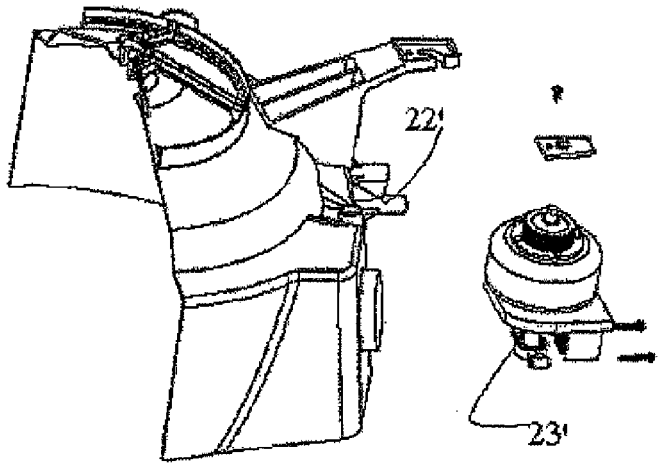
Figure 5C:
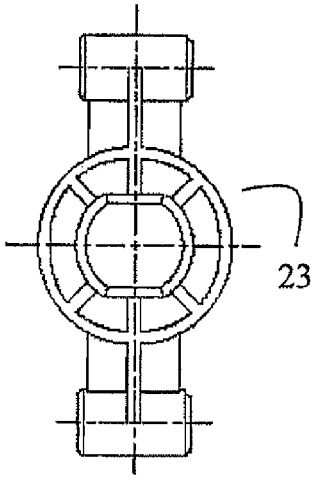
Figure 5D:
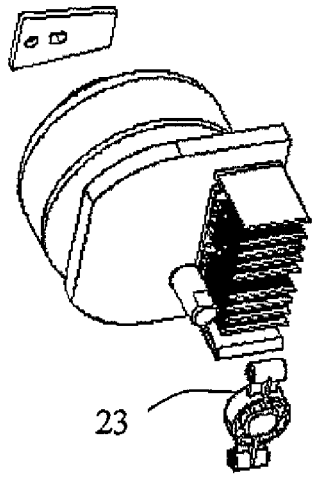

A further embodiment, schematically shown in FIG. 4, provides that the insertion and clamping plate 18 is directly assembled on the central axis 10; the insertion of the insertion and clamping plate 18 in the first arm 5 is allowed by the longitudinal slot 15 and it occurs simultaneously with the insertion of the central axis 10 in the assisted-insertion slot 6.

Figure 6A:
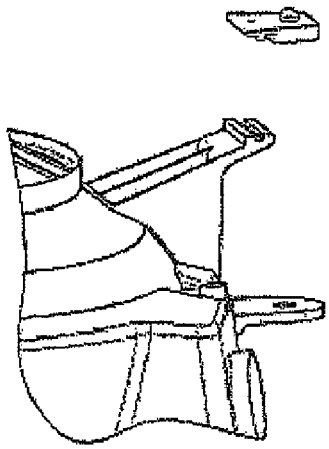
FIGS. 6*a*, 6*b*, 6*c* schematically show the washing tank close to the fixing bracket associated with a coupling plate respectively exploded, exploded with the motor being inserted, assembled and clamped.
Figure 6B:
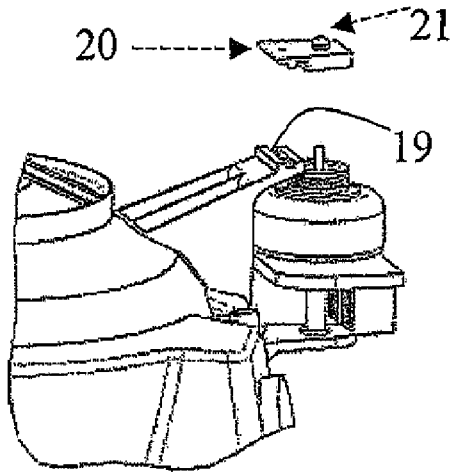
Figure 6C:
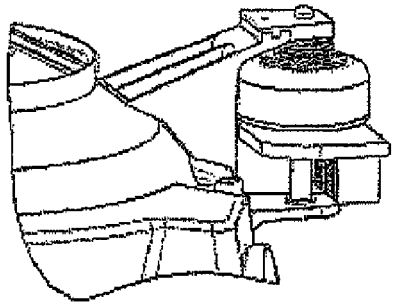

FIG. 6 shows a further alternative embodiment wherein a joint plate 21 is fitted to the central axis 10 by means of a non-through hole 21; the final fixing of the central axis 10 to the fixing bracket 3 occurs by jointing the joint plate 21 in the insertion channel 19 of the first arm 5.

In all the above-described embodiments, the central axis 10 is engaged in the through hole 8 of the second arm 7. Alternatively the second arm 7 can comprise, as FIG. 5 shows, a screwing bearing 22. In that case a screwing bush 23, allowing the central axis 10 to be fixed to the screwing bearing 22, is fitted on the lower part of the axis 10

The locking system and method according to the present invention thus solve the technical problem and they achieve several advantages, the first being given by the fact that the assembly of the washing machine electric motor is considerably simplified by an engaging insertion and rapid fixing.

Moreover, the system according to the invention ensures that the electric motor fixing is balanced and that the washing machine operation is not changed in time.

I claim:

1. A washing machine and similar rotary-drum household appliances, comprising:

an electric motor with a central axis; and a washing tank;

wherein said appliance comprises a fixing bracket to fix the electric motor to the tank; and wherein said bracket comprises a first arm, a second arm and means associated with at least one of said first and second arms to clamp the central axis of the electric motor;

wherein said means comprise an assisted-insertion slot made at the end of said first arm;

wherein said first arm comprises a grove obtained on the surface thereof and a coupling plate with the groove, having a through hole with the same shape as the upper end of the central axis.

2. The washing machine according to claim 1, wherein said washing tank and said fixing bracket are monolithic.

3. The washing machine according to claim 1, wherein said second arm has at the end thereof an engaging through hole.

4. The washing machine according to claim 3, wherein said engaging through hole obtained in the second arm and the lower end of the central axis engaging in the engaging through hole, have a conjugate shape and such as to prevent the rotary motion.

5. The washing machine according to claim 1, wherein paid washing tank comprises at least one bush.

6. The washing machine according to claim 5, wherein said means comprise a screwing bearing to the bushes, fitted onto the central axis.

7. A washing machine and similar rotary-drum household appliances, comprising:

an electric motor with a central axis; and a washing tank;

wherein said appliance comprises a fixing bracket to fix the electric motor to the tank; and wherein said bracket comprises a first arm, a second arm and means associated with at least one of said first and second arm to clamp the central axis of the electric motor;

wherein said means comprise an assisted-insertion slot made at the end of said first arm;

wherein said means comprise a longitudinal slot parallel to the surface of the first arm made at said assisted insertion slot;

wherein said machine comprises an insertion and clamping plate, sideways inserted through the central axis in the end of the assisted-insertion slot and clamped in the longitudinal insertion slot;

wherein said longitudinal slot at the end part of the assisted-insertion slot ensures a secure clamping motion of said insertion and clamping plate;

wherein the secure clamping motion of said insertion and clamping plate within the longitudinal slot is a rotary motion.

8. The washing machine according to claim 7, wherein the secure clamping motion of said insertion and clamping plate within the longitudinal slot is a semicircular motion.

9. A washing machine and similar rotary-drum household appliances, comprising:

an electric motor with a central axis; and a washing tank;

wherein said appliance comprises a fixing bracket to fix the electric motor to the tank; and wherein said bracket comprises a first arm, a second arm and means associated with at least one of said first and second arm to clamp the central axis of the electric motor;

wherein said means comprise an assisted-insertion slot made at the end of said first arm;

wherein said means comprise a longitudinal slot being parallel to the surface of the first arm made at said assisted insertion slot;

wherein said machine comprises an insertion and clamping plate directly assembled on said central axis, which can be inserted through the longitudinal slot jointly with the central axis and clamped in the longitudinal insertion slot itself;

wherein said longitudinal slot at the end part of the assisted-insertion slot ensures a secure clamping motion of said insertion and clamping plate;

wherein the secure clamping motion of said insertion and clamping plate within the longitudinal slot is a rotary motion.

10. The washing machine according to claim 9, wherein the secure clamping motion of said insertion and clamping plate within the longitudinal slot is a semicircular motion.

11. A washing machine and similar rotary-drum household appliances, comprising:

an electric motor with a central axis; and a washing tank;

wherein said appliance comprises a fixing bracket to fix the electric motor to the tank; and wherein said bracket comprises a first arm, a second arm and means associated with at least one of said first and second arm to clamp the central axis of the electric motor;

wherein said means comprise a joint insertion groove made at the end of said first arm and a joint plate with the joint insertion groove, having a non-through hole with the same shape as the upper end of the central axis.

* * * * *